US005553681A

United States Patent [19]

Huffstutler et al.

[11] Patent Number: 5,553,681

[45] Date of Patent: Sep. 10, 1996

[54] ROTARY CONE DRILL BIT WITH ANGLED RAMPS

[75] Inventors: Alan D. Huffstutler; Harry M. Campos, Jr., both of Grand Prairie, Tex.

[73] Assignee: Dresser Industries, Inc., Dallas, Tex.

[21] Appl. No.: 350,910

[22] Filed: Dec. 7, 1994

[51] Int. Cl.[6] ..... E21B 10/18

[52] U.S. Cl. ..... 175/339; 175/374; 175/375

[58] Field of Search ..... 175/331, 337, 175/338, 339, 374, 375, 377, 394

[56] References Cited

U.S. PATENT DOCUMENTS

| | | | |
|---|---|---|---|
| Re. 19,339 | 10/1934 | Vertson | 175/347 |
| Re. 32,495 | 9/1987 | Coates | 175/339 |
| 1,906,427 | 5/1933 | Sievers et al. | 175/292 |
| 1,908,049 | 5/1933 | Reed | 175/313 |
| 2,030,723 | 2/1936 | Scott et al. | 175/362 |
| 2,047,112 | 7/1936 | Reed | 175/363 |
| 2,063,012 | 12/1936 | Catland | 175/357 |
| 2,064,273 | 12/1936 | Scott | 175/342 |

(List continued on next page.)

FOREIGN PATENT DOCUMENTS

| | | | |
|---|---|---|---|
| 936382 | 12/1955 | Germany . | |
| 533719 | 10/1976 | U.S.S.R. | 175/393 |
| 1305295 | 4/1987 | U.S.S.R. | 175/374 |
| 1467157 | 3/1989 | U.S.S.R. | 175/339 |

OTHER PUBLICATIONS

International Search Report, International Application No. PCT/US95/10015, dated Jan. 4, 1996.

U.S. Design patent application No. 29/043782, filed Sep. 12, 1995, entitled Rotary Cone Drill Bit.

U.S. patent application Ser. No. 08/351,019 filed Dec. 7, 1994 and entitled Rotary Cone Drill Bit and Method for Enhanced Lifting of Fluids and Cuttings.

U.S. patent application Ser. No. 08/422,140 filed Apr. 13, 1995 and entitled Rotary Drill Bit and Method for Manufacture and Rebuild.

U.S. patent application Ser. No. 08/478455 filed Jun. 6, 1995 and entitled Rotary Cone Drill Bit Modular Arm.

U.S. patent application Ser. No. 29/033,599 filed Jan. 17, 1995 and entitled Rotary Cone Bit.

U.S. patent application Ser. No. 29/033,630 filed Jan. 17, 1995 and entitled Support Arm and Rotary Cone for Modular Drill Bit.

Security/Dresser "Security Oilfield Catalog" Rock Bits, Diamond Products, Drilling Tools, *Security Means Technology* Nov. 1991.

"State of the Science in Rock Bit Techn." by Carlos Fernandez, Spacebit Aug. 1991.

U.S. patent application Ser. No. 08/287,457, filed Aug. 8, 1994 and entitled Rock Bit With Enhanced Fluid Return Area.

U.S. patent application Ser. No. 08/287,446, filed Aug. 8, 1994 and entitled Modular Rotary Drill Bit.

U.S. patent application Ser. No. 08/287,441, filed Aug. 8, 1994 and entitled Rotary Cone Drill Bit With Improved Support Arms.

U.S. patent application Ser. No. 08/287,390, filed Aug. 8, 1994 and entitled Rotary Cone Drill Bit and Method for Manufacture and Rebuild.

*Primary Examiner*—David J. Bagnell
*Attorney, Agent, or Firm*—Baker & Botts, L.L.P.

[57] ABSTRACT

A rotary cone drill bit for forming a borehole having a bit body with an upper end portion adapted for connection to a drill string. A number of support arms extend from the bit body. Each support arm has an exterior surface. A number of cutter cone assemblies equal to the number of support arms are mounted respectively on the support arms and project generally downwardly and inwardly with respect to an associated support arm. A ramp is formed on the exterior surface of the support arm and is inclined at an angle from a leading edge of the support arm toward a trailing edge of the support arm such that the ramp directs cuttings upward in the borehole.

22 Claims, 3 Drawing Sheets

U.S. PATENT DOCUMENTS

| | | | |
|---|---|---|---|
| 2,065,743 | 12/1936 | Reed | 175/366 |
| 2,068,375 | 1/1937 | Catland | 175/357 |
| 2,124,521 | 7/1938 | Williams et al. | 175/366 |
| 2,151,347 | 3/1939 | Fisher | 175/363 |
| 2,176,358 | 10/1939 | Pearce | 175/354 |
| 2,260,487 | 10/1941 | Scott | 175/340 |
| 2,318,370 | 5/1943 | Burch | 175/366 |
| 2,634,105 | 4/1953 | Gruner | 175/341 |
| 2,648,526 | 8/1953 | Lanchester | 175/340 |
| 2,782,005 | 2/1957 | Appleton | 175/339 |
| 2,950,090 | 8/1960 | Swart | 175/340 |
| 3,130,801 | 4/1964 | Schumacher, Jr. | 175/374 |
| 3,442,342 | 5/1969 | McElya et al. | 175/374 |
| 3,628,616 | 12/1971 | Neilson | 175/375 |
| 3,800,891 | 4/1974 | White et al. | 175/374 |
| 3,825,083 | 7/1974 | Flarity et al. | 175/394 |
| 3,850,256 | 11/1974 | McQueen | 175/228 |
| 4,054,772 | 10/1977 | Lichte | 219/121.14 |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Vezirian | 384/96 |
| 4,209,124 | 6/1980 | Baur et al. | 228/182 |
| 4,256,194 | 3/1981 | Varel | 175/375 |
| 4,280,571 | 7/1981 | Fuller | 175/337 |
| 4,333,364 | 6/1982 | Varel | 76/108.2 |
| 4,350,060 | 9/1982 | Vezirian | 76/108.2 |
| 4,352,400 | 10/1982 | Grappendorf et al. | 175/330 |
| 4,369,849 | 1/1983 | Parrish | 175/340 |
| 4,417,629 | 11/1983 | Wallace | 175/356 |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,624,329 | 11/1986 | Evans et al. | 175/374 |
| 4,630,693 | 12/1986 | Goodfellow | 175/366 |
| 4,635,728 | 1/1987 | Harrington | 166/341 |
| 4,711,143 | 12/1987 | Loukanis et al. | 76/108.2 |
| 4,727,943 | 3/1988 | Wood | 175/229 |
| 4,750,573 | 6/1988 | Wynn | 175/359 |
| 4,765,205 | 8/1988 | Higdon | 76/108.2 |
| 4,813,502 | 3/1989 | Dysart | 175/337 |
| 4,817,852 | 4/1989 | Hill | 228/114 |
| 4,848,491 | 7/1989 | Burridge et al. | 175/393 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett et al. | 175/57 |
| 5,145,016 | 9/1992 | Estes | 175/331 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kumar et al. | 75/240 |
| 5,289,889 | 3/1994 | Gearhart et al. | 175/325.5 |
| 5,351,768 | 10/1994 | Scott et al. | 175/374 |
| 5,439,067 | 8/1995 | Huffstutler | 175/339 |
| 5,439,068 | 8/1995 | Huffstutler et al. | 175/356 |

FIG. 6
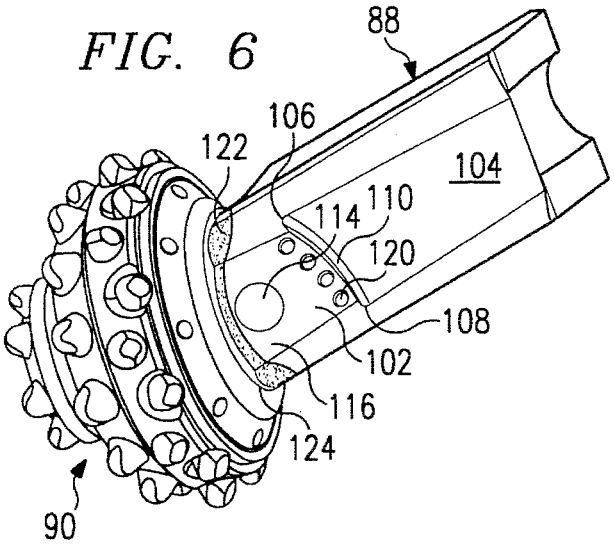
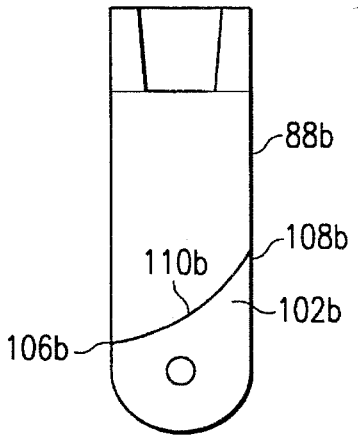
FIG. 8
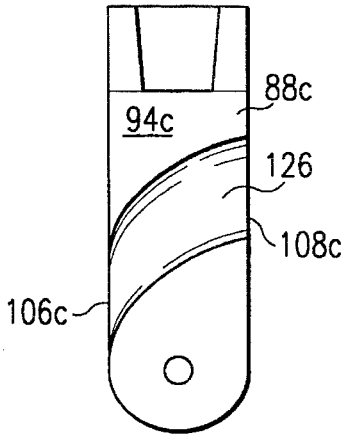
FIG. 9
FIG. 7
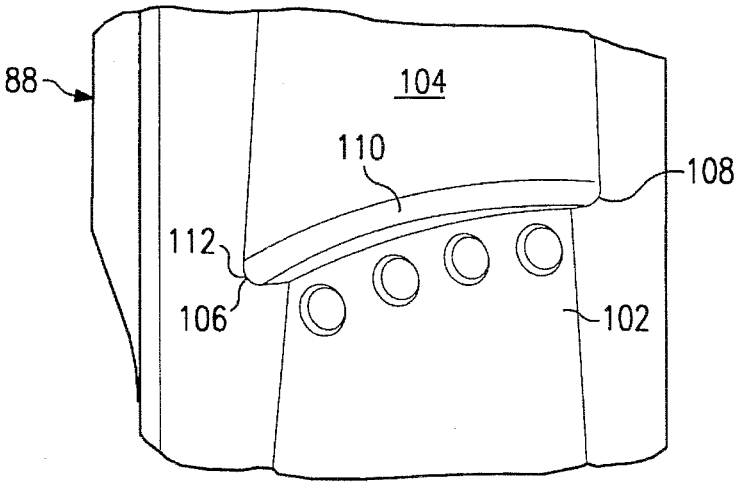
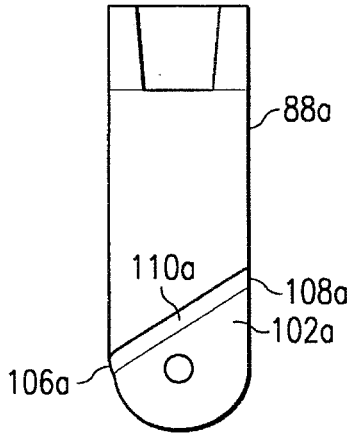
FIG. 10

ROTARY CONE DRILL BIT WITH ANGLED RAMPS

RELATED APPLICATIONS

This application is related to patent application entitled ROTARY CONE DRILL BIT AND METHOD FOR ENHANCED LIFTING OF FLUIDS AND CUTTINGS, Ser. No. 08/351,019, filed Dec. 7, 1994 (Attorney Docket No. 60220-0178); design patent application entitled ROTARY CONE DRILL BIT now abandoned Ser. No. 29/033,599, filed Jan. 17, 1995 Attorney docket No. 60220-0173); design patent application entitled SUPPORT ARM AND ROTARY CONE FOR MODULAR DRILL BIT Ser. No. 29/033,630, filed Jan. 17, 1995 (Attorney Docket No. 60220-0174).

TECHNICAL FIELD OF THE INVENTION

This invention relates in general to the field of rotary drill bits used in drilling a borehole in the earth and in particular to a rotary cone drill bit with angled ramps.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper end adapted for connection to a drill string. A plurality of support arms, typically three, depend from the lower end portion of the bit body with each arm having a spindle protruding radially inward and downward with respect to a projected rotational axis of the bit body.

Conventional roller cone bits are typically constructed in three segments. The segments may be positioned together longitudinally with a welding groove between each segment. The segments may then be welded with each other using conventional techniques to form the bit body. Each segment also includes an associated support arm extending from the bit body. An enlarged cavity or passageway is typically formed in the bit body to receive drilling fluids from the drill string. U.S. Pat. 4,054,772 entitled, Positioning System for Rock Bit Welding shows a method and apparatus for constructing a three cone rotary rock bit from three individual segments. U.S. Pat. No. 4,054,772 is incorporated by reference for all purposes within this application.

A cutter cone is generally mounted on each spindle and supported rotatably on bearings acting between the spindle and the inside of a spindle receiving cavity in the cutter cone. One or more nozzles may be formed on the underside of the bit body adjacent to the support arms. The nozzles are typically positioned to direct drilling fluid passing downwardly from the drill string through the bit body toward the bottom of the borehole being formed. Drilling fluid is generally provided by the drill string to perform several functions including washing away material removed from the bottom of the borehole, cleaning the cutter cones, and carrying the cuttings radially outward and then upward within the annulus defined between the exterior of the bit body and the wall of the borehole. U.S. Pat. No. 4,056,153 entitled, Rotary Rock Bit with Multiple Row Coverage for Very Hard Formations and U.S. Pat. No. 4,280,571 entitled, Rock Bit show examples of conventional roller cone bits with cutter cone assemblies mounted on a spindle projecting from a support arm. U.S. Pat. No. 4,056,153 and U.S. Pat. No. 4,280,571 are incorporated by reference for all purposes within this application.

While drilling with such rotary or rock bits, fluid flow in the vicinity of the cutter cones may be very turbulent, thereby inhibiting an even, upward flow of cuttings and other debris from the bottom of the borehole through the annulus to the well surface. Furthermore, such debris may collect in downhole locations with restricted fluid flow. Examples of such locations with restricted fluid flow include the lower portion of the bit body adjacent to the respective support arms and the annulus area between the exterior of the bit body and the adjacent wall of the borehole. Other areas of restricted fluid flow may include the backface of the respective cutter cones and the wall of the borehole. As a result of collecting such debris, the area available for fluid flow is reduced even further resulting in an increase in fluid velocity through such areas and erosion of the adjacent metal components. As this erosion progresses, vital components such as bearings and seals may be exposed to drilling fluids and well debris which can lead to premature failure of the associated rock bit.

SUMMARY OF THE INVENTION

In accordance with the present invention, the disadvantages and problems associated with previous rock bits and rotary cone drill bits have been substantially reduced or eliminated. In one embodiment, the present invention includes a support arm and cutter cone assembly which provide enhanced fluid flow around the exterior of an associated rotary drill bit during drilling operations for removal of cuttings and other debris from the bottom of the borehole to the well surface. A ramp is provided on an exterior surface of each support arm. The ramp is formed at an angle such that a top surface of the ramp slopes generally upward from the leading edge of the support arm to the trailing edge. The ramp has a predetermined thickness so as to provide a gap between the support arm and the wall of a borehole above the ramp. The ramp aids the flow of fluid, cuttings, and other debris to the annulus formed between the wall of the borehole and the exterior of an associated drill string.

In another aspect, the present invention includes a slot or channel extending generally downward along the leading edge of the ramp from a top surface of the ramp toward the shirttail of the support arm. The slot or channel aids in directing cuttings, fluid and other debris away from the cutter cones and toward the top surface of the ramp and to the annulus.

A technical advantage of the present invention includes that the ramp divides turbulent fluid flow around the rotating cutter cones from fluid flow in the annulus above the cutter cones such that cuttings and other debris entering the annulus are not drawn back down toward the cutter cones. The outer diameter of the ramp is substantially equal to the diameter of the borehole. Thereby, the ramp in cooperation with other components of the bit body separates fluid at the drill bit into two substantially independent regions. Fluid flow below the ramp is turbulent and multidirectional due to the fluid exiting the nozzles and the churning effect of the cutter cones. Fluid flow above the ramp is relatively less turbulent and unidirectional upwardly through the annulus because the trailing edge of the ramp is preferably located above the exit end of the nozzles and the cutter cones. Thus, fluid flow in this region is not subject to the churning action of the cutter cones or downward flow from the nozzles.

Another technical advantage of the present invention includes that the ramp provides a means for lifting cuttings and other debris upward to the annulus and away from the cutter cones. As the drill bit rotates, fluid and debris move upward along the ramp toward the annulus. This reduces the effect of cuttings interfering with the area available for fluid flow.

Another technical advantage of the present invention includes that use of a ramp on the support arm provides a gap between the support arm above the ramp and the wall of the borehole thereby increasing the upward flow of fluid and debris.

Another technical advantage of the present invention includes that the channel or slot allows cuttings and other debris to be picked up and directed toward the ramp at the leading edge of the ramp.

BRIEF DESCRIPTION OF THE DRAWINGS

For a more complete understanding of the present invention, and the advantages thereof, reference is now made to the following description taken in conjunction with the accompanying drawings in which like reference numbers indicate like features and wherein:

FIG. 6 is an isometric view of a support arm of the rotary cone drill bit of FIG. 5 having a ramp constructed according to the teachings of the present invention;

FIG. 7 is an enlarged drawing in elevation of the support arm of FIG. 6;

FIG. 8 is a side view of another embodiment of the support arm of FIG. 6;

FIG. 9 is a side view of another embodiment of the support arm of FIG. 6; and FIG. 10 is a side view of another embodiment of the support arm of FIG. 6.

DETAILED DESCRIPTION OF THE INVENTION

The present invention and its advantages are best understood by referring to FIGS. 1 through 10 of the drawings, like numerals being used for like and corresponding parts of the drawings.

Figure 1:
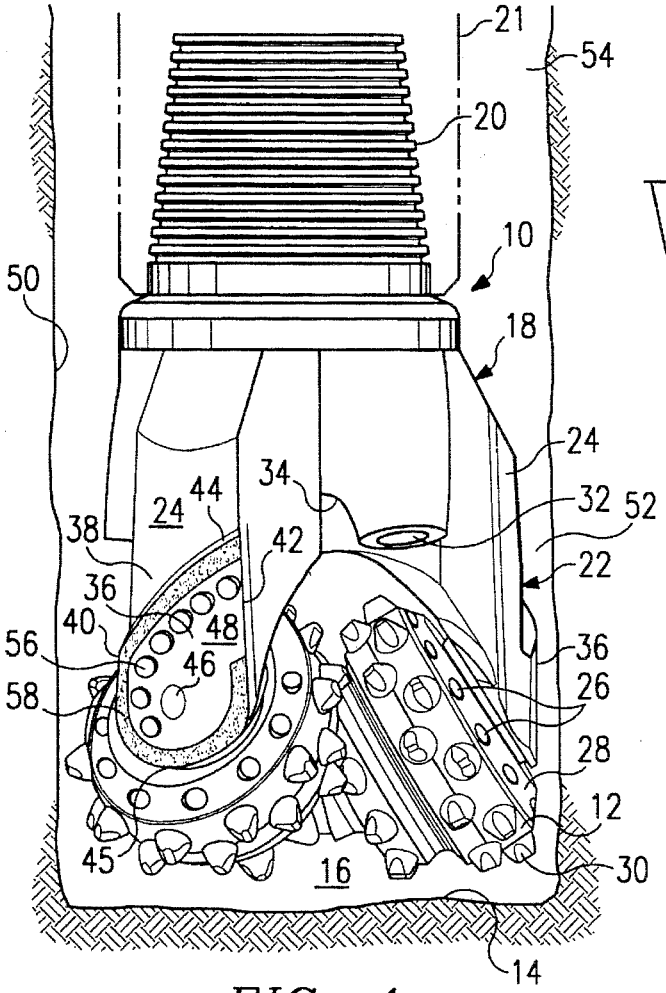
FIG. 1 is an isometric view of an embodiment of a rotary cone drill bit having a ramp constructed according to the teachings of the present invention.

FIG. 1 illustrates a roller cone rock bit, indicated generally at 10, constructed according to the teachings of one aspect of the present invention. Roller cone rock bit 10 may be used to drill a borehole by the cutting action of cutter cones 12 as roller cone rock bit 10 is rolled around bottom 14 of borehole 16 by the rotation of a drill string (not shown) attached to roller cone rock bit 10.

Roller cone rock bit 10 comprises a bit body 18 having a tapered, externally threaded upper section 20 adapted to be secured to the lower end of the drill string 21. Three cutter assemblies (two visible in FIG. 1) indicated generally at 22, depend from bit body 18. In this embodiment, cutter assemblies 22 and bit body 18 comprise an integrated unit. Each cutter assembly 22 preferably comprises a support arm 24 and a cutter cone 12.

Each cutter cone 12 may include a number of surface compacts 26 disposed in a gauge face surface 28 of each cutter cone 12. Each cutter cone 12 may also include a number of teeth 30. Surface compacts 26 and teeth 30 may comprise compacts or inserts that are formed from various hard materials as desired. Alternatively, teeth 30 may be milled from cutter cone 12 itself.

During drilling, borehole debris is removed from bottom 14 of borehole 16. A number of nozzles 32 extend from an underside 34 of roller cone rock bit 10 and supply drilling fluid to aid in the removal of the debris. The drilling fluid flows radially outward between the underside 34 and bottom 14 of borehole 16. A number of ramps 36 located on support arms 24 also aid in the removal process.

Ramp 36 is disposed on exterior surface 38 of support arm 24. Ramp 36 may be formed out of each support arm 24 by a machining operation. Alternatively, ramp 36 may be formed on exterior surface 38 of support arm 24 by first depositing weld material on surface 38. The weld material may then be machined to a desired shape for ramp 36. Finally, ramp 36 may be formed on support arm 24 during the process of forging support arm 24. After support arm 24 has been forged, ramp 36 may be further machined to define its desired structure.

Figure 3:
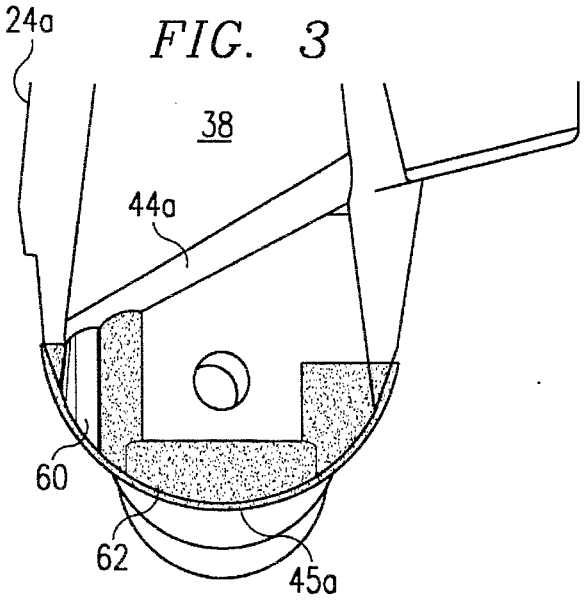
FIG. 3 is a side view of the support arm of FIG. 2.

Ramp 36 comprises a leading edge 40, trailing edge 42 and top surface 44. Ramp 36 extends from leading edge 40 to trailing edge 42 and from top surface 44 to shirttail 45 of support arm 24 on surface 38. Top surface 44 of ramp 36 slopes generally upward along surface 38 of support arm 24 from leading edge 40 to trailing edge 42. Top surface 44 may comprise a flat surface, a concave surface or any other appropriate surface for aiding in the removal of debris from borehole 16. As shown in FIG. 3, top surface **44*a* is a curved surface. Top surface 44*a* slopes downward and extends from exterior surface 38*a* of support arm 24*a*. At trailing edge 42, top surface 44 is preferably located at or above the exit of nozzle 32. It is desirable to have top surface 44 at leading edge 40 be as low as possible on support arm 24 so as to aid in removal of cuttings and other debris. For some applications top surface 44 at leading edge 40 of ramp 36 may be located at approximately the same level as ball plug hole 46**.

Ramp 36 has a thickness defined by top surface 44. The thickness of ramp 36 may be chosen such that an outer surface 48 of ramp 36 is located a predetermined distance from a wall 50 of borehole 16 when roller cone rock bit 10 is disposed in borehole 16. For one application, outer surface 48 of ramp 36 should be separated from wall 50 of borehole 16 by approximately 0.03 inches or more. The use of ramp 36 allows formation of gap 52 between surface 38 of support arm 24 and wall 50 of borehole 16. Gap 52 allows increased fluid flow up into an annulus 54 formed between wall 50 of borehole 16 and the exterior of drill string 21.

Ramp 36 may be protected by inserts, hardfacing, or both. As shown in FIG. 1, Ramp 36 is protected by a plurality of inserts 56 and hardfacing 58. Inserts 56 are disposed in ramp 36 along leading edge 40 and top surface 44. Additionally, hardfacing 58 is disposed on surface 48 along shirttail 45, leading edge 40 and adjacent to top surface 44. Hardfacing 58 may comprise, for example, chips or particles of tungsten carbide or other appropriate material for resisting wear on ramp 36.

Roller cone rock bit 10 operates to scrape and gauge the sides and bottom 14 of borehole 16 utilizing surface compacts 26 and teeth 30 under downhole force supplied through the drill string. Roller cone rock bit 10 rotates to the right in borehole 16. Cutter cones 12 create cuttings and other debris at bottom 14 of borehole 16. Drilling fluid is ejected from nozzles 32 toward cutter cones 12. As roller cone rock bit 10 rotates, leading edge 40 of ramp 36 picks up cuttings and fluid. The fluid and cuttings move up along surface 44 toward trailing edge 42 of ramp 36 and thus flow upward into annulus 54 toward the surface of borehole 16.

Figure 2:
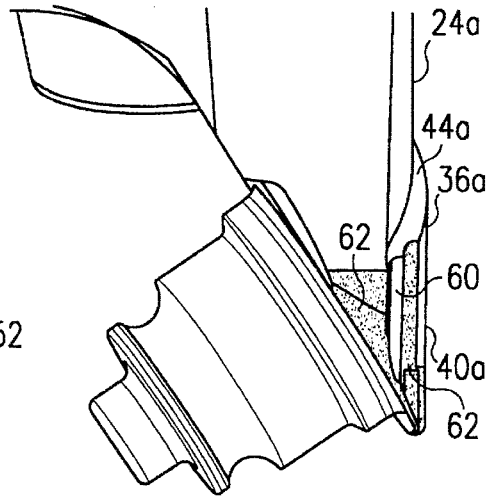
FIG. 2 is an enlarged drawing in elevation and with portions broken away showing a support arm of another embodiment of a rotary cone drill bit constructed according to the teachings of the present invention.

FIG. 2 is enlarged drawing in elevation with portions broken away showing a support arm 24*a* constructed according to the teachings of the present invention. Support arm 24*a* comprises a ramp 36*a* having a surface 44*a* for aiding removal of cuttings and other debris from the bottom of the borehole (not shown). A channel or slot 60 is formed in leading edge 40*a* of ramp 36*a*. Channel 60 aids in directing cuttings, debris, and fluid up towards surface 44*a* of ramp 36*a*. Ramp 36*a* also comprises hardfacing 62 disposed on leading edge 40*a* of ramp 36 adjacent slot or channel 60 so as to protect ramp 36*a*.

Figure 4:
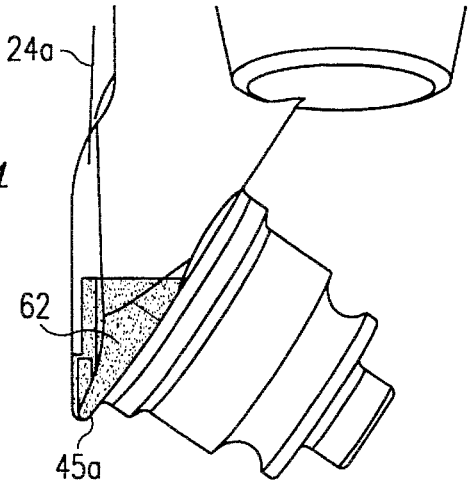
FIG. 4 is a side view of the support arm of FIG.

FIGS. 3 and 4 show side views of support arm 24*a* of FIG. 2. Hardfacing 62 may also be disposed along shirttail 45*a* as well as adjacent to slot 60. Furthermore, an appropriate hardfacing material may be disposed in slot 60 and on surface 44*a*. Such hardfacing material may comprise a powder of tungsten carbide material.

Figure 5:
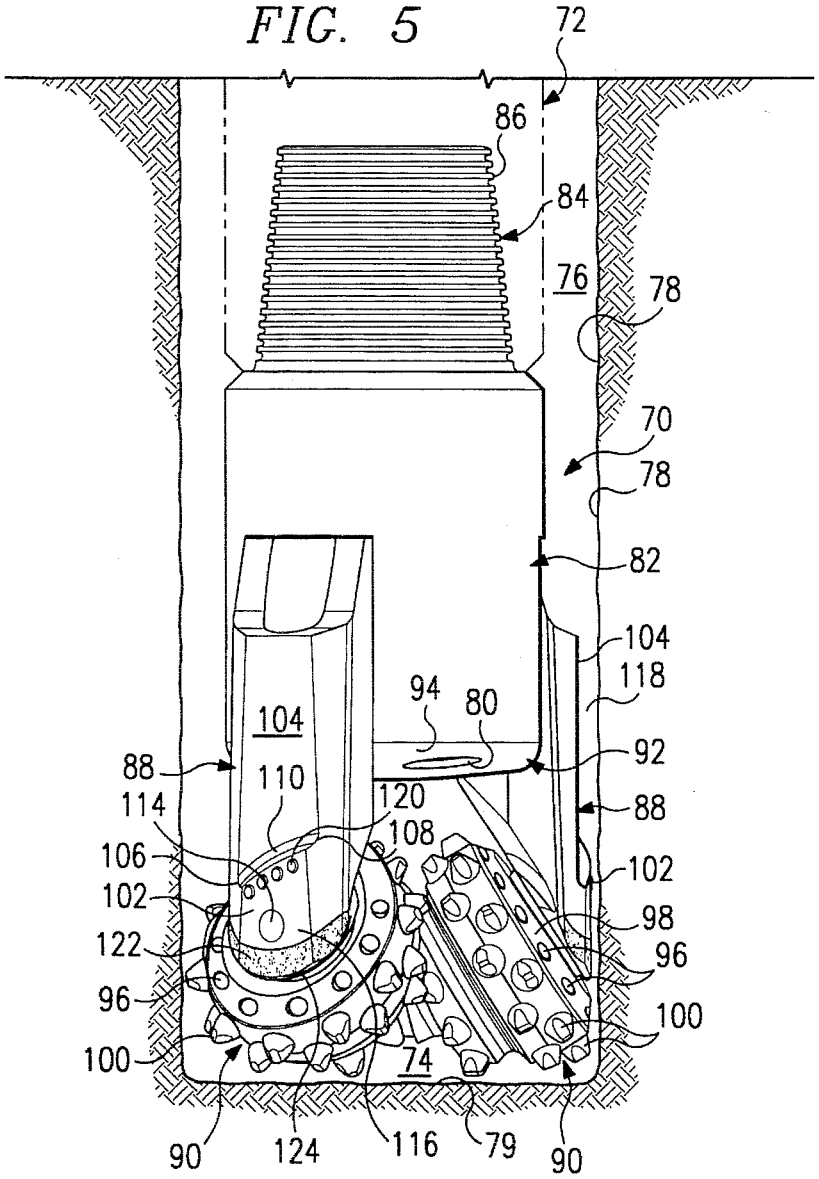
FIG. 5 is an isometric view of another embodiment of a rotary cone drill bit having a ramp constructed according to the teachings of the present invention.

FIG. 5 is an isometric drawing of a rotary cone drill bit indicated generally at 70 constructed according to the teachings of the present invention and shown attached to a drill string 72 and disposed in a borehole 74. Annulus 76 is formed between exterior surface of drill string 72 and the interior or wall 78 of borehole 74. In addition to rotating drill bit 70, drill string 72 is often used to provide a conduit for communicating drilling fluids and other fluids from the well surface to drill bit 70 at the bottom of borehole 74. Such drilling fluids may be directed to flow from drill string 72 to various nozzles 80 provided in drill bit 70. Cuttings formed by drill bit 70 and any other debris at the bottom of borehole 74 will mix with the drilling fluids exiting from nozzles 80 and returned to the well surface via annulus 76.

Drill bit 70 preferably comprises a one-piece or unitary body 82 with upper portion 84 having a threaded connection or pin 86 adapted to secure drill bit 70 with the lower end of drill string 72. Three support arms (two visible) 88 are preferably attached to and extend longitudinally from bit body 82 opposite from pin 86. Each support arm 88 preferably includes a cutter cone 90. Cutter cone 90 extends generally downwardly and inwardly from support arm 88.

Bit body 82 includes lower portion 92 having a generally convex exterior surface 94 formed thereon. The dimensions of convex surface 94 and the location of cutter cones 90 are selected to optimize fluid flow between lower portion 92 of bit body 82 and cutter cone 90. The location of each cutter cone 90 relative to a lower portion 92 may be varied by adjusting the length of the associated support arm 88 and the spacing of each support arm 88 on the exterior of bit body 82.

Cutter cone 90 may further comprise a plurality of surface compacts 96 disposed in a gauge face surface 98 of each cutter cone 90. Each cutter cone 90 may also include a number of teeth 100. Surface compacts 96 and teeth 100 may comprise compacts or inserts that are formed from various hard materials as desired. Alternatively, teeth 100 may be milled from cutter cone 90 itself.

Each support arm 88 also comprises a ramp 102 to aid in the process of removing cuttings and other debris from borehole 74. Ramp 102 is disposed on an exterior surface 104 of support arm 88. Ramp 102 may be formed out of each support arm 88 by a machining operation. Alternatively, ramp 102 may be formed on exterior surface 104 of support arm 88 by first depositing well material on surface 104. The raw material may then be machined to a desired shape for ramp 102. Finally, ramp 102 may be formed on support arm 88 during the process of forging support arm 88. After support arm 88 has been forged, ramp 102 may be further machined to define its desired structure. Support arm 88 and ramp 102 are also shown in FIGS. 6 and 7.

Ramp 102 comprises leading edge 106, trailing edge 108 and top surface 110. Top surface 110 slopes generally upward along surface 104 of support arm 88 from leading edge 106 to trailing edge 108. Top surface 110 may comprise a flat surface, a concave surface, or any other appropriate surface for aiding in the removal of cuttings and other debris from borehole 74. As shown in enlarged FIG. 7, top surface 110 comprises a concave surface having a predetermined radius of curvature shown at 112. Top surface 110 slopes generally downward and extends from exterior surface 104. At trailing edge 108, top surface 110 is preferably located at or above the exit of nozzle 80. It is noted that top surface 110 may be disposed lower on support arm 88 if nozzle 80 is located closer to the center of bit body 82. It is desirable to have leading edge 106 be as low as possible on support arm 88 so as to aid in removal of cuttings and other debris. For some applications, top surface 110 at leading edge 106 may be located at approximately the same level as ball plug hole 114.

Ramp 102 has a thickness defined by top surface 110. The thickness of ramp 102 may be chosen such that an outer surface 116 of ramp 102 is located at a predetermined distance from a wall 78 of borehole 74 when roller cone rock bits 70 is disposed in borehole 74. The use of ramp 102 allows formation of gap 118 between surface 104 of support arm 88 and wall 78 of borehole 74. Gap 118 allows increased fluid flow up into annulus 76.

Ramp 102 may be protected by a plurality of inserts 120 that are disposed in surface 116 adjacent top surface 110. Additionally, hardfacing 122 may be disposed on a shirttail 124 of support arm 88.

Roller cone rock bit 70 operates to scrape and gouge walls 78 and bottom 79 of borehole 74 utilizing compacts 96 and teeth 100 under downhole force supplied through the drill string 72. Roller cone rock bit 70 rotates to the right in borehole 74. Cutter cones 90 create cuttings and other debris at bottom 79 of borehole 74. Drilling fluid is ejected from nozzles 80 toward cutter cones 90. As roller cone rock bit 70 rotates, leading edge 106 of ramp 102 picks up cuttings and fluid. The fluid and cuttings move up along surface 110 toward trailing edge 108 of ramp 102 and thus flow upward into annulus 76 toward the surface of borehole 74.

The slope and structure of ramp 102 may be varied without departing from the teachings of the present invention. For example, ramp 102*a* may have a linear slope from leading edge 106*a* to trailing edge 108*a* along surface 110*a*. Alternatively, ramp 102*b* of FIG. 8 may have a nonuniform slope along the length of top surface 110*b*. As shown in FIG. 9, ramp 102 of FIGS. 5 through 7 may be replaced with a flow path 126 formed in surface 94*c* of support arm 88*c*. As with ramp 102, channel 126 may slope generally upwardly from leading edge 106*c* to trailing edge 108*c* of support arm 88*c*.

Although the present invention and its advantages have been described in detail, it should be understood that various changes, substitutions and alterations can be made therein without departing from the spirit and scope of the invention as defined by the appended claims. For example, the ramp may not extend along the entire width of a support arm.

What is claimed is:

1. A rotary cone drill bit for forming a borehole, comprising:

a bit body having an upper end portion adapted for connection to a drill string for rotation of said bit body;

a number of support arms extending from said bit body, each of said support arms having a leading edge, a trailing edge, an exterior surface disposed therebetween, and a lower shirttail portion;

a number of cutter cone assemblies equaling said number of support arms and rotatably mounted respectively on said support arms projecting generally downwardly and inwardly with respect to its associated support arm; and a ramp formed on the exterior surface of each of said support arms, said ramps having a top surface inclined at an angle from said leading edge of said respective support arm toward said trailing edge of said respective support arm, said ramp extending along said exterior surface of said support arm between said top surface of said ramp and said shirtail of said support arm such that said ramps cooperate with each other to direct cuttings and fluid upwardly in the borehole.

2. The drill bit of claim 1, and further comprising a nozzle having an exit, said nozzle disposed adjacent to one of said support arms, wherein said top surface of said ramp at said trailing edge is positioned above said exit.

3. The drill bit of claim 1, wherein said ramp is formed integral with said respective support arm.

4. The drill bit of claim 1, wherein said top surface comprises a concave surface having a radius of curvature and sloping generally downward and extending from said exterior surface of said support arm.

5. The drill bit of claim 1, wherein said ramp has approximately a linear slope from said leading edge of said support arm to said trailing edge of said support arm.

6. The drill bit of claim 1, wherein said ramp further comprises hardfacing formed adjacent to said top surface of said ramp.

7. The drill bit of claim 1, wherein said ramp further comprises a plurality of inserts disposed in an outer surface of said ramp.

8. The drill bit of claim 1, wherein an outer diameter of said ramp is approximately equal to a maximum outer diameter of the drill bit such that as the drill bit is rotated in a borehole, said ramp forces the flow of cuttings along said ramp upwards and away from a bottom of the borehole.

9. The drill bit of claim 1, and further comprising a channel formed along said leading edge of said ramp to aid in directing cuttings and fluid toward an upper surface of said ramp.

10. The drill bit of claim 1, wherein said cutter cone assemblies each comprise a cutter cone having a plurality of teeth milled out of said cutter cone.

11. A support arm and cutter cone assembly for a rotary cone drill bit having a bit body, comprising:

said support arm extending from said bit body and having a leading edge, a trailing edge, an exterior surface formed therebetween and a lower shirttail portion;

said cutter cone assembly rotatably mounted on said support arm and projecting generally downwardly and inwardly with respect to said support arm; and a ramp body formed on said exterior surface of said support arm, said ramp having a top surface inclined at an angle from said leading edge of said support arm toward said trailing edge of said support arm, said ramp body extending along said exterior surface of said support arm between said top surface of said ramp and said shirttail of said support arm such that said ramp directs cuttings upwardly in a borehole.

12. The support arm of claim 11, and further comprising a nozzle having an exit, said nozzle disposed adjacent to each support arm, wherein said top surface of said ramp at said trailing edge is positioned above said exit.

13. The support arm of claim 11, wherein said ramp body is formed integral with said support arm.

14. The support arm of claim 11, wherein said top surface comprises a concave surface having a radius of curvature and sloping generally downward and extending from said exterior surface of said support arm.

15. The support arm of claim 11, wherein said ramp body has approximately a linear slope from said leading edge of said support arm to said trailing edge of said support arm.

16. The support arm of claim 11, wherein said ramp body further comprises hardfacing formed adjacent said top surface and leading edge of said ramp body.

17. The support arm of claim 11, wherein said ramp body further comprises a plurality of inserts disposed in an outer surface of said ramp body.

18. The support arm of claim 11, wherein an outer diameter of said ramp body is approximately equal to a maximum outer diameter of the drill bit such that as the drill bit is rotated in a borehole, said ramp body forces the flow of cuttings along said ramp body upwards and away from a bottom of the borehole.

19. The support arm of claim 11, and further comprising a channel formed along said leading edge of said ramp body to aid in directing cuttings and fluid toward an upper surface of said ramp body.

20. The support arm of claim 11, wherein said cutter cone assemblies each comprise a cutter cone having a plurality of teeth milled out of said cutter cone.

21. A support arm and cutter cone assembly for a rotary cone drill bit having a bit body, comprising:

said support arm extending from said bit body and having an exterior surface and a lower shirttail portion;

said cutter cone assembly mounted on said support arm and projecting generally downwardly and inwardly with respect to said support arm;

a ramp body formed on said exterior of said support arm, said ramp having a top surface inclined at an angle from a leading edge of said support arm toward a trailing edge of said support arm, said ramp body extending along said exterior surface of said support arm between said top surface of said ramp body and said shirttail of said support arm such that said ramp body directs cuttings upwardly in the borehole;

a channel formed along said leading edge of said ramp body to direct cuttings toward said top surface of said ramp body;

a plurality of inserts disposed in said ramp body; and a hardfacing material disposed on a leading edge of said ramp body adjacent said channel and a shirttail of said support arm.

22. The support arm of claim 21, wherein said ramp body provides one boundary of a flow path formed in said support arm to allow removal of debris from a borehole.

* * * * *